US009643097B2

(12) United States Patent
Manichon

(10) Patent No.: US 9,643,097 B2
(45) Date of Patent: May 9, 2017

(54) ARTICULATED TOY ROBOT WITH FRAME, BASE, BUILDING ACCESSORIES, AND KITS THEREFOR

(71) Applicant: Virginie Manichon, San Francisco, CA (US)

(72) Inventor: Virginie Manichon, San Francisco, CA (US)

( * ) Notice: Subject to any disclaimer, the term of this patent is extended or adjusted under 35 U.S.C. 154(b) by 0 days.

(21) Appl. No.: 14/939,299

(22) Filed: Nov. 12, 2015

(65) Prior Publication Data

US 2016/0136531 A1 May 19, 2016

Related U.S. Application Data

(60) Provisional application No. 62/081,546, filed on Nov. 18, 2014.

(51) Int. Cl.

| | |
|---|---|
| ***A63H 3/46*** | (2006.01) |
| ***A63H 33/04*** | (2006.01) |
| ***A63H 33/08*** | (2006.01) |

(52) U.S. Cl.

CPC ..... *A63H 3/46* (2013.01); *A63H 33/044* (2013.01); *A63H 33/08* (2013.01)

(58) Field of Classification Search

USPC ... 446/85, 97, 102, 108, 118, 119, 370, 379, 446/380, 381

See application file for complete search history.

(56) References Cited

U.S. PATENT DOCUMENTS

| | | | | |
|---|---|---|---|---|
| 1,329,959 | A | 2/1920 | Criest | |
| 1,555,661 | A * | 9/1925 | Grove | A63H 3/46 446/380 |
| 2,421,279 | A * | 5/1947 | Marty | A63H 7/00 446/331 |
| 2,825,178 | A | 3/1958 | Hawkins | |
| 2,877,506 | A * | 3/1959 | Almoslino | A47C 7/16 273/155 |
| 3,222,072 | A | 12/1965 | Dreyer | |
| 3,577,673 | A | 5/1971 | Monestier | |
| 4,466,799 | A * | 8/1984 | Argiro | G09B 19/02 434/203 |
| 4,699,602 | A | 10/1987 | Giorgi | |
| 4,997,375 | A | 3/1991 | Heinz | |
| 5,110,130 | A | 5/1992 | Aulicino | |
| 5,302,148 | A | 4/1994 | Heinz | |
| 5,525,089 | A * | 6/1996 | Heinz | A63F 9/088 434/204 |
| 5,628,667 | A | 5/1997 | Levi | |
| D459,412 | S | 6/2002 | Fong | |
| D461,856 | S | 8/2002 | Fong | |
| 6,482,063 | B1 * | 11/2002 | Frigard | A63H 3/16 446/119 |
| D467,630 | S | 12/2002 | Kawakita et al. | |
| D468,372 | S | 1/2003 | Foschino | |
| D468,374 | S | 1/2003 | So | |

(Continued)

*Primary Examiner* — Kurt Fernstrom

(74) *Attorney, Agent, or Firm* — Patential; Keum Park

(57) ABSTRACT

Disclosed are toy robots having a frame, base and building accessories and kits therefor. The toy has a system of blocks, gripping appendages, gears and pop-up joints threaded together by an elastic cable held in tension. This configuration allows the toy to stand tall or short, be configured in myriad poses In or outside its frame, on or off its accessories, and can allow for the discovery of a secret cavity.

29 Claims, 18 Drawing Sheets

(56) References Cited

U.S. PATENT DOCUMENTS

D468,375 S 1/2003 So
D468,781 S 1/2003 Foschino
D469,479 S 1/2003 Foschino
D472,283 S 3/2003 Akashi
D475,094 S 5/2003 Ko
D478,362 S 8/2003 Nakase
D479,287 S 9/2003 Nakase
D479,288 S 9/2003 Nakase
D479,567 S 9/2003 Matsumoto et al.
D479,862 S 9/2003 Takahashi
D480,118 S 9/2003 Nakase
D481,081 S 10/2003 Okutsu
D483,816 S 12/2003 Nakase
D484,196 S 12/2003 Nakase
D484,197 S 12/2003 Nakase
D484,927 S 1/2004 Foschino
D486,191 S 2/2004 Robinson
D490,486 S 5/2004 Hornsby et al.
D492,359 S 6/2004 So
D493,850 S 8/2004 Ward
D497,637 S 10/2004 Cetera
D505,984 S 6/2005 Robinson
D507,024 S 7/2005 Okutsu
D507,309 S 7/2005 Nakase
D507,310 S 7/2005 Nakase
D507,606 S 7/2005 Nakase
D507,607 S 7/2005 Nakase
D508,096 S 8/2005 Koshiishi
D508,967 S 8/2005 Robinson
D509,267 S 9/2005 Robinson
D509,268 S 9/2005 Robinson
D510,754 S 10/2005 Tajima
D510,962 S 10/2005 Nakase
D510,963 S 10/2005 Nakase
D510,964 S 10/2005 Robinson
D515,639 S 2/2006 Robinson
D522,071 S 5/2006 Strother et al.
D524,882 S 7/2006 Maddocks et al.
D526,366 S 8/2006 Maddocks et al.
D529,105 S 9/2006 Saruhashi
7,147,537 B1 * 12/2006 Klein ..... A63H 3/16
446/370
D534,970 S 1/2007 Saucier
D534,971 S 1/2007 Chung
D536,044 S 1/2007 Ban
D536,045 S 1/2007 Judkins et al.
D537,891 S 3/2007 Judkins et al.
D541,353 S 4/2007 Takahashi
D553,696 S 10/2007 Sato et al.
D554,205 S 10/2007 Sato et al.
D554,713 S 11/2007 Wong
D555,213 S 11/2007 Bowen et al.
D555,214 S 11/2007 Wong
D558,281 S 12/2007 Sato et al.
D559,288 S 1/2008 Matsuda
D561,211 S 2/2008 Mitchell
D561,213 S 2/2008 Mitchell
D561,215 S 2/2008 Mitchell
D561,216 S 2/2008 Mitchell
D561,795 S 2/2008 Mitchell
D561,796 S 2/2008 Mitchell
D561,797 S 2/2008 Mitchell
D561,848 S 2/2008 Robinson
D566,793 S 4/2008 Mitchell
D566,795 S 4/2008 Judkins et al.
D570,926 S 6/2008 Robinson
D570,927 S 6/2008 Robinson
D570,928 S 6/2008 Robinson
D578,170 S 10/2008 Chiang et al.
D581,994 S 12/2008 Wilk et al.
D583,882 S 12/2008 Domingues
D588,654 S 3/2009 Sato et al.
D591,802 S 5/2009 Sato et al.
D592,257 S 5/2009 Tang
D593,164 S 5/2009 Sonoda
D593,165 S 5/2009 Hetrick et al.
D598,964 S 8/2009 Harano et al.
7,592,053 B2 * 9/2009 Mansfield ..... G09F 19/00
428/12
D603,912 S 11/2009 Miller
D606,131 S 12/2009 Ajitsu et al.
D609,287 S 2/2010 Kinzer
D614,251 S 4/2010 Chung
D619,180 S 7/2010 Chan
D621,886 S 8/2010 Lee
D622,786 S 8/2010 Lee
D624,610 S 9/2010 Wu et al.
D630,269 S 1/2011 Matsuda et al.
D631,923 S 2/2011 Stoddard
D639,351 S 6/2011 Newmayer et al.
D639,353 S 6/2011 Stibolt
D639,354 S 6/2011 Weeks
D641,808 S 7/2011 Matsuda
D645,523 S 9/2011 Wong
D647,147 S 10/2011 Wong
D647,148 S 10/2011 Wong
D647,149 S 10/2011 Wong
D654,961 S 2/2012 Onodera et al.
D656,564 S 3/2012 Kratz
D657,829 S 4/2012 Gettings et al.
D658,501 S 5/2012 Modaberi
D662,154 S 6/2012 Hara et al.
D662,155 S 6/2012 Yu
D662,156 S 6/2012 Chen
D662,157 S 6/2012 Chiu
D663,791 S 7/2012 Wong
D663,792 S 7/2012 Wong
D667,510 S 9/2012 Hayakawa et al.
D667,512 S 9/2012 Mimlitch et al.
D667,898 S 9/2012 Gettings et al.
D669,138 S 10/2012 Wong
D669,140 S 10/2012 Mimlitch et al.
D669,942 S 10/2012 Mimlitch et al.
D669,943 S 10/2012 Mimlitch et al.
D670,769 S 11/2012 Mimlitch et al.
D670,770 S 11/2012 Mimlitch et al.
D671,175 S 11/2012 Koshiishi
D672,408 S 12/2012 Ohler et al.
D674,028 S 1/2013 Takahashi et al.
D674,029 S 1/2013 Takahashi et al.
D674,030 S 1/2013 Takahashi et al.
D675,264 S 1/2013 Mimlitch et al.
D675,265 S 1/2013 Mimlitch et al.
D676,505 S 2/2013 Mimlitch et al.
D676,506 S 2/2013 Mimlitch et al.
D676,507 S 2/2013 Mimlitch et al.
D677,346 S 3/2013 Horikawa
D677,347 S 3/2013 Mimlitch et al.
D677,742 S 3/2013 Mimlitch et al.
D677,743 S 3/2013 Koshiishi
D677,744 S 3/2013 Yu
D678,428 S 3/2013 Mimlitch et al.
D680,177 S 4/2013 Wong
D681,133 S 4/2013 Chen
D681,134 S 4/2013 Lee
D682,368 S 5/2013 Mimlitch et al.
D682,952 S 5/2013 Vaslin et al.
D682,953 S 5/2013 Mimlitch et al.
D685,438 S 7/2013 Fan et al.
D687,908 S 8/2013 Hoang
D688,329 S 8/2013 Hoang
D689,146 S 9/2013 Mimlitch et al.
D689,147 S 9/2013 Mimlitch et al.
D689,148 S 9/2013 Mimlitch et al.
D689,149 S 9/2013 Mimlitch et al.
D689,150 S 9/2013 Mimlitch et al.
D689,151 S 9/2013 Mimlitch et al.
D689,562 S 9/2013 Mimlitch et al.
D689,563 S 9/2013 Mimlitch et al.
D689,564 S 9/2013 Mimlitch et al.
D689,565 S 9/2013 Mimlitch et al.
D689,566 S 9/2013 Wong
D689,960 S 9/2013 Mimlitch et al.
D689,961 S 9/2013 Mimlitch et al.

(56) References Cited

U.S. PATENT DOCUMENTS

| | | | | |
|---|---|---|---|---|
| D689,962 | S | 9/2013 | Mimlitch et al. | |
| D692,964 | S | 11/2013 | Gettings et al. | |
| D692,965 | S | 11/2013 | Mimlitch et al. | |
| D693,889 | S | 11/2013 | Mimlitch et al. | |
| D694,839 | S | 12/2013 | Gettings et al. | |
| D694,840 | S | 12/2013 | Mimlitch et al. | |
| D695,362 | S | 12/2013 | Mimlitch et al. | |
| D696,324 | S | 12/2013 | Takahashi | |
| D700,251 | S | 2/2014 | Mimlitch et al. | |
| 8,651,909 | B2 * | 2/2014 | Romzek | B63B 35/73 114/219 |
| D700,661 | S | 3/2014 | Mimlitch et al. | |
| D704,279 | S | 5/2014 | Murayama et al. | |
| D704,280 | S | 5/2014 | Murayama et al. | |
| D709,141 | S | 7/2014 | Parker et al. | |
| D709,967 | S | 7/2014 | Takahashi et al. | |
| D710,953 | S | 8/2014 | Katsutani et al. | |
| D711,479 | S | 8/2014 | Lee | |
| D711,480 | S | 8/2014 | Lee | |
| D712,983 | S | 9/2014 | Gan | |
| D712,984 | S | 9/2014 | Lee | |
| D713,477 | S | 9/2014 | Lee | |
| D715,379 | S | 10/2014 | Kitamura | |
| D715,380 | S | 10/2014 | Ito | |
| D715,381 | S | 10/2014 | Ito | |
| D715,382 | S | 10/2014 | Ito | |
| D717,888 | S | 11/2014 | Lee et al. | |
| D719,620 | S | 12/2014 | Clerc | |
| D719,621 | S | 12/2014 | Song | |
| D720,378 | S | 12/2014 | Dye et al. | |
| D721,408 | S | 1/2015 | Fujioka et al. | |
| D721,409 | S | 1/2015 | Fujioka et al. | |
| D721,771 | S | 1/2015 | Nakano et al. | |
| D725,167 | S | 3/2015 | Song et al. | |
| D725,200 | S | 3/2015 | Katz et al. | |
| D726,836 | S | 4/2015 | Song et al. | |
| D734,821 | S | 7/2015 | Greaves et al. | |
| D735,816 | S | 8/2015 | Lee et al. | |
| 9,266,029 | B2 * | 2/2016 | Beglan | A63H 3/04 |
| 2003/0172205 | A1 | 9/2003 | Bastian | |
| 2012/0156960 | A1 | 6/2012 | Weeks | |

* cited by examiner

ARTICULATED TOY ROBOT WITH FRAME, BASE, BUILDING ACCESSORIES, AND KITS THEREFOR

CROSS-REFERENCE

This application claims the benefit of U.S. Provisional Application No. 62/081,546, filed Nov. 18, 2014, which application is incorporated herein by reference.

BACKGROUND OF THE INVENTION

Existing articulated toy robots are typically made of solid wood blocks that allow for a limited number of configurations. When standing on both feet, these articulated toy robots cannot change height. Their blocky appendages do not have gripping capability, nor do they offer a variety of tactile experiences. Moreover, these previously described articulated toys do not have elements of surprise or accessories that enhance a child's play.

SUMMARY

Disclosed is an articulatable toy that can be arranged in a multitude of configurations in and outside of a frame. The articulatable toy can be a robot in form factor. The toy can stand on both feet, tall or short. It has joints that twist and pop into place. It has gripping appendages that can interconnect, grip its frame and other accessories. The present toy also has shapes that enhance tactility, a secret cavity that adds an element of surprise and a unique robot identification number.

The articulable toy can be made from a myriad of materials and have component parts of a wide variety of shapes. For example, wood forms and gear-like shapes held in tension with an elastic cable (or cord) passing through slots, apertures, and cavities. It should be noted that the shapes may also be made from plastic, resin, cardboard, stone, metal, fabric, leather or other suitable materials. A large number of shapes can be interconnected by the elastic components to achieve a wide variety of final configurations. Depending on the material used, the shapes may be painted, waxed, stained, dyed, printed or clear coated. The present components can primarily be disks and gears, but may also be a variety of other tactile shapes without departing from the scope of the disclosure.

Joints, such as pop-up elbows and knees, allows for the lengthening and shortening of the toy in a standing or sitting position. Gripping hands and feet allow for additional configurations in and outside its frame, on or off the building accessories.

A secret cavity with one or more hidden hearts can be provided which adds an element of discovery. Other shapes, including shapes inspired by anatomy, can be used as well. As will be appreciated by those skilled in the art, there may be more than one secret cavity.

As disclosed, the pop-up joint has a disk shape with two slots or notches an opposing sides and a through-hole or aperture in communication between the two slots. An elastic cable is passed through the aperture to connect the joint to one or more other elements. Thus, for example, a limb having an elastic cable passing through multiple components keeps the elements of the limb in a state of tension. When pulling on the last appendage of a limb, the joint automatically pops-up in a twisting fashion extending the overall length of the limb from the thickness of the joint element to the diameter of the joint element.

The gripping appendage is designed with a slot that allows for lengthening/shortening and a slot that allows for gripping.

This configuration permits all of the elements of the limbs to move in all directions: lateral and circular as well as shortening, lengthening and gripping. The design of the articulated toy is not limited to a robot. It may include other articulated toys such as a dog, companion and other robot family members, robot friends or enemies.

An aspect of the disclosure is directed to a kit for an articulatable toy. Suitable kits comprise: a primary block having a primary block aperture passing therethrough along an axis; a secondary block having a secondary block aperture passing at least partially therethrough along an axis, a primary channel formed through a portion of the secondary block, and at secondary channel formed through a portion of the secondary block in perpendicular communication with the primary channel; four or more spacers having an aperture passing therethrough along an axis; one or more mid-spacer elements having a first mid-spacer element notch and a second mid-spacer element notch formed along an axis and having an aperture therethrough from the first mid-spacer element notch to the second mid-spacer element notch; and a cable. The channels are formed on an exterior surface of the block. Kits can additionally comprise an end component having a first end component notch and a second end component notch formed perpendicularly to the first end component notch and an aperture therethrough from the first end component notch to the second end component notch. The end component can further have a rounded end and a flat end. Additionally, the kit can include one or more ornamental feature elements configurable to engage a surface of the primary block or the secondary block. Ornamental feature elements can have a shape selected from semi-circular, round, square, oval, ovoid, triangular, rectangular, and gear shaped. Other organic shapes, such as amoeba-like or sponge-like, can be used without departing from the scope of the disclosure. Additionally, the ornamental feature elements can be configurable to engage a detent on a surface of the primary block or the secondary block. One or more secondary spacers can be included in the kit, wherein the secondary spacers have a diameter that is larger or smaller than a diameter of the four or more spacers. In some configurations, the primary block has a shape selected from semi-circular, round, square, oval, ovoid, triangular, and rectangular, and the secondary block can have a shape selected from semi-circular, round, square, oval, ovoid, triangular, and rectangular. Primary and secondary blocks can have similar shapes without departing from the scope of the disclosure. The secondary block can further have two or more additional primary channels formed through a portion of the block which are not in communication with another primary channel, and at two or more secondary channels formed through a portion of the block not in communication with another secondary channel and each in perpendicular communication with one of the additional primary channels. One or more frames and bases can also be included. Additionally, one or more planar shapes can be provided, such as planar shapes in the form of a building, a rocket, or other structure.

Another aspect of the disclosure is directed to an articulatable toy. Suitable articulatable toys comprise: a primary block having an aperture passing therethrough along an axis; a secondary block having a secondary block aperture passing at least partially therethrough along an axis, a primary channel formed through a portion of the secondary block, and at secondary channel formed through a portion of the secondary block in perpendicular communication with the primary channel; four or more spacers having an aperture passing therethrough along an axis; one or more mid-spacer elements having a first mid-spacer element notch and a second mid-spacer element notch formed along an axis and having an aperture therethrough from the first mid-spacer element notch to the second mid-spacer element notch; and a cable passing through an aperture of at least the primary block, the secondary block, the four or more spacers and at least one mid-spacer. Additionally, an end component can be provided which has a first end component notch and a second end component notch formed perpendicularly to the first end component notch and an aperture therethrough from the first end component notch to the second end component notch. The channels can be formed on an exterior surface of the block. The end component can have a rounded end and a flat end. One or more ornamental feature elements can also be provided which are configurable to engage a surface of the primary block or the secondary block. The ornamental feature elements can have a variety of shapes including, semi-circular, round, square, oval, ovoid, triangular, rectangular, and gear shaped. Other organic shapes, such as amoeba-like or sponge-like, can be used without departing from the scope of the disclosure. Additionally, the ornamental feature elements are configurable to engage a detent on a surface of the primary block or the secondary block. Additionally, one or more secondary spacers, wherein the secondary spacers have a diameter that is larger or smaller than a diameter of the four or more spacers. The primary block can also have a shape selected from semi-circular, round, square, oval, ovoid, triangular, and rectangular, and the secondary block can have a shape selected from semi-circular, round, square, oval, ovoid, triangular, and rectangular. The secondary block can have two or more additional primary channels formed through a portion of the block which are not in communication with another primary channel, and at two or more secondary channels formed through a portion of the block not in communication with another secondary channel and each in perpendicular communication with one of the additional primary channels.

Still another aspect of the disclosure is directed to a method of making an articulatable toy. Suitable methods comprise: tying a knot at a first end of a cable; passing the cable through an aperture of a primary block having an axial aperture therethrough; passing the cable through an aperture of a secondary block having a primary channel formed through a portion of the block, and at secondary channel formed through a portion of the block in perpendicular communication with the primary channel; passing the cable through an aperture of a four or more spacers having an aperture passing therethrough along an axis; passing the cable through an aperture of a one or more mid-spacer elements having a first mid-spacer element notch and a second mid-spacer element notch formed along an axis and having an aperture therethrough from the first mid-spacer element notch to the second mid-spacer element notch; and tying a knot at a second end of the cable.

Yet another aspect of the disclosure is directed to an articulatable toy comprising: a primary block means having an aperture passing therethrough along an axis; a secondary block means having a secondary block aperture passing at least partially therethrough along an axis, a primary channel formed through a portion of the secondary block means, and at secondary channel formed through a portion of the secondary block means in perpendicular communication with the primary channel; four or more spacer means having an aperture passing therethrough along an axis; one or more mid-spacer element means having a first mid-spacer element notch and a second mid-spacer element notch formed along an axis and having an aperture therethrough from the first mid-spacer element notch to the second mid-spacer element notch; and a cable means passing through an aperture of at least the primary block means, the secondary block means, the four or more spacer means and at least one mid-spacer means. The articulatable toy can further include an end component means having a first end component notch and a second end component notch formed perpendicularly to the first end component notch and an aperture therethrough from the first end component notch to the second end component notch. In some configurations, the articulatable toy further comprises one or more ornamental feature element means configurable to engage a surface of the primary block means or the secondary block means. Additionally, one or more secondary spacer means can be provided, wherein the secondary spacer means have a diameter that is larger or smaller than a diameter of the four or more spacers. In some configurations, at least one of the primary block means and the secondary block means has a shape selected from semicircular, round, square, oval, ovoid, triangular, and rectangular. Additionally, the secondary block means can have two or more additional primary channels formed through a portion of the block which are not in communication with another primary channel, and at two or more secondary channels formed through a portion of the block not in communication with another secondary channel and each in perpendicular communication with one of the additional primary channels.

INCORPORATION BY REFERENCE

All publications, patents, and patent applications mentioned in this specification are herein incorporated by reference to the same extent as if each individual publication, patent, or patent application was specifically and individually indicated to be incorporated by reference. See, for example, U.S. Pat. No. 2,825,178 A to Hawkins issued Mar. 4, 1956 for Articulated Toy Set of Building Blocks; US 2012/015690 A1 to Weeks published Jun. 21, 2012 for Transformable Toy Robot; U.S. Pat. No. 6,482,063 B1 to Frigard issued Nov. 19, 2002 for Articulating Blocks Toy; U.S. Pat. No. 5,302,148 A to Heinz issued Apr. 12, 1994 for Rotatable Demountable Blocks of Several Shapes on a Central Elastic; and U.S. Pat. No. 5,525,089 A to Heinz issued Jun. 11, 1996 for Rotatable Demountable Blocks of Several Shapes on a Central Elastic Anchor.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

The articulated toy is comprised of a plurality of elements: Elements include three or more of a head element, an ear element, an eye element, a wrist element, a neck/limb element, a torso element, a fanciful element (such as a heart), an elbow/knee joint element, a hand (paw) element, an ankle element, a foot (paw) element, a frame element and a base element. The articulated toy can be provided in a kit form for later assembly or can be provided formed. Where the articulated toy is provided in a formed configuration, users can disassemble the articulated toy and reassembly in different configurations as desired.

Figure 1:
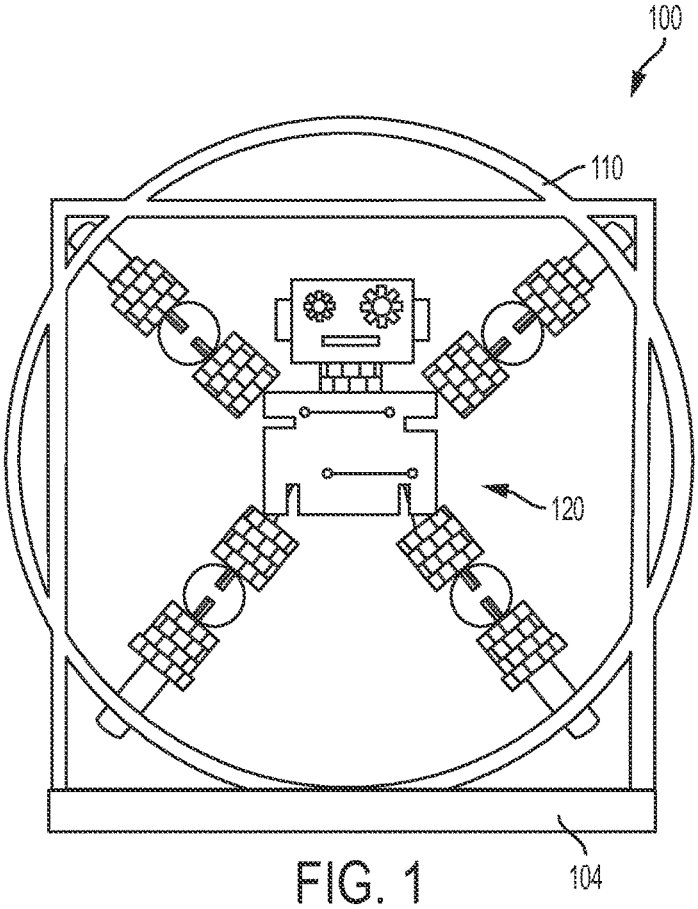
FIG. 1 is a front view of an articulated toy positioned in a frame having a base.
Figure 2A:
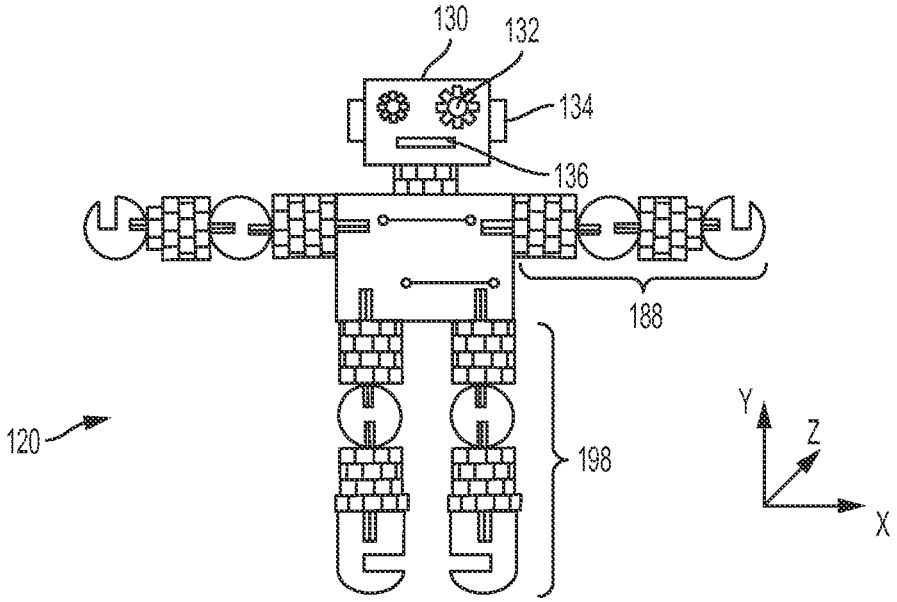
FIG. 2A illustrates front view of an articulated toy having a plurality of joints, with joints in extended position.
Figure 3:
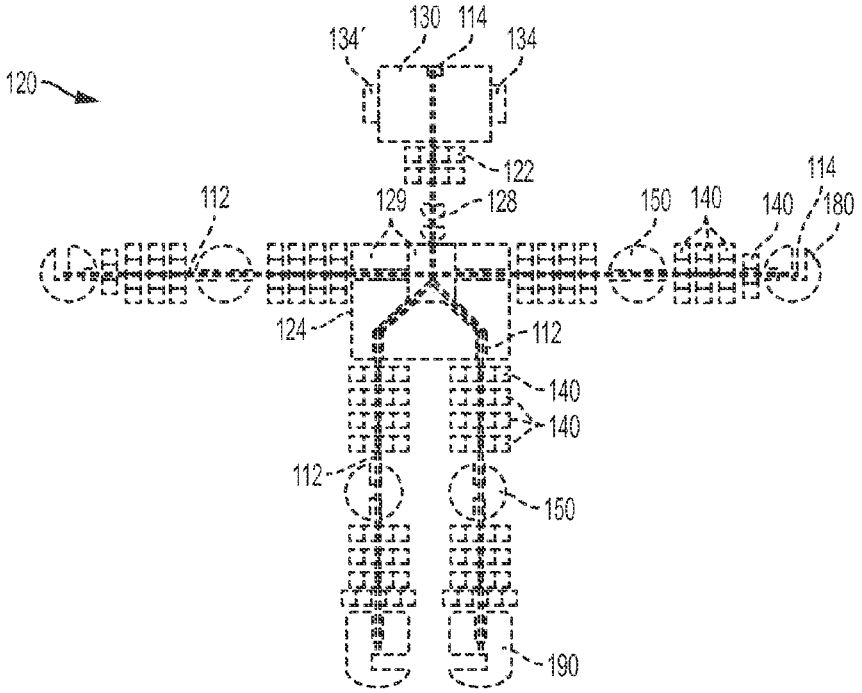
FIG. 3 illustrates an articulated toy with the interior apertures visible.

FIG. 1 is a front view of combination 100 of an articulated toy 120 positioned in a frame 110 having a base 104. As shown in FIG. 2A, the articulated toy 120 has a first block 130, forming a head, which is configurable to have one or more decorative components affixed to the first block 130. The decorative elements can be countersunk or applied on the surface. The block can be square, rectangular, semicircular, circular, or any other suitable three dimensional shape with a height, width and depth. Furthermore the first block 130 can be solid with an aperture or through-hole passing through the first block 130 on an axis, or be formed from a hollow body. The aperture can have a diameter at a first end and a second end that is the same, or can be counter-sunk (as shown in FIG. 3). The through-hole can be centrally positioned through the block, as illustrated.

A first set of decorative elements are, for example, circular elements 134 having two substantially planar surfaces parallel one another and an aperture therethrough which enables the one or more circular elements 134 to be affixed to an exterior surface of the first block 130. One or more second decorative elements 132 can be in the form of a cog having two substantially planar surfaces parallel one another and a series of teeth formed on an exterior surface. FIG. 2A illustrates a front view of an articulated toy 120 having a plurality of elements with joints in extended position, thereby optimizing the overall length of the appendage extending from the central block. Additional externally positioned decorative elements can be provided without departing from the scope of the disclosure. Moreover, the decorative elements can each have different dimension and level of detail (e.g., the number of teeth on one decorative cog might be different than the number of teeth on another decorative cog). The articulated toy 120 is shown with an x-y-z axis to facilitate understanding the operational ability of the various elements or appendages to roll, pitch and yaw about an x, y and z axis or to move within a plane. Etching 136 can also be provided on any of the components, as illustrated on the first block 130.

Figure 2B:
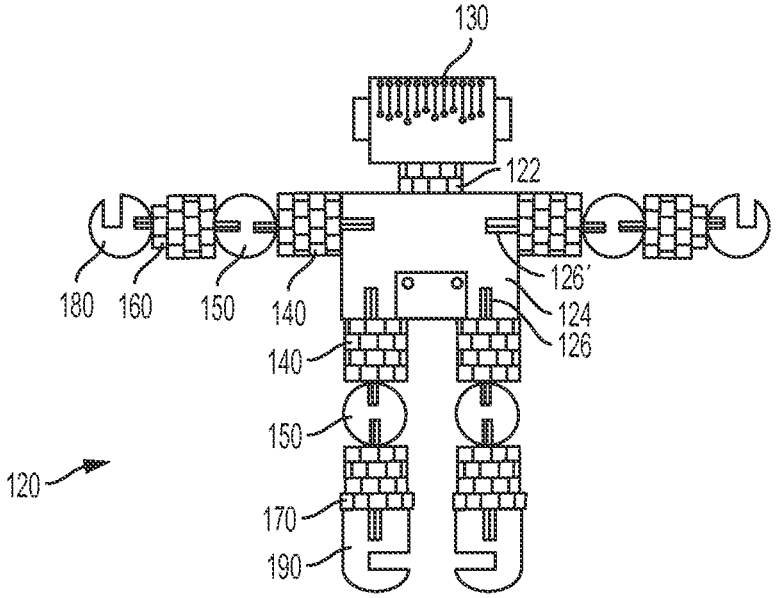
FIG. 2B illustrates a back view of the articulated toy of FIG. 2A.

FIG. 2B illustrates a back view of the articulated toy 120 of FIG. 2A. Positionable below the first block 130 is at least one spacer element 122. A second block 124 is provided. The second block 124 can be the torso or central block from which other elements or appendages radiate. The second block 124 has a central through hole aperture 129 (shown in FIGS. 3, 8 and 9) positioned in a first axial direction at least part way through the second block 124. The central through hole aperture 129 can be countersunk at its opening thus forming a compartment within the second block 124. The central through hole aperture 129 is further configured to have four or more channels 126 formed in the second block 124 along an exterior surface of the block. A first pair of channels 126' are formed on opposing sides of the second block 124 and can be aligned along an axis. A second set of channels 126 are formed adjacent to each other on the same side of the second block 124. The second set of channels 126 can be formed so that the channels are in communication with the central through hole aperture 129 but are only partially parallel. A third set of channels is positionable on opposing sides of the second block 124 and in a perpendicular relationship one of a first or second channel of the first pair of channels, or a first or second channel of the second pair of channels. The perpendicular arrangement between channels, allows the appendages formed from primary mid spacer elements, secondary spacer elements, and end elements to be configured to extend from the second block to move in at least three directions from a starting position within an x-y plane of the second block 124. Thus, for example, each length for a first appendage 188 comprising the primary spacer elements 140, primary mid-spacers 150 and first end component 180 can be moved through the channels in a range of 180° in the x-z plane; and 90° in the x-y plane. Similarly, each length for a second appendage 198 comprising the primary spacer elements 140, primary mid-spacers 150 and second end component 190 can be moved through the channels in a range of 180° in the y-z plane; and 90° in the x-y plane. Other channel orientations may be provided to provide a different range of motion for the extensions without departing from the scope of the disclosure. Each of the first appendage 188 and the second appendage 198 can further be bent through a range of 180° at the primary mid-spacers 150 and the components can rotate about the long axis (e.g., x axis for the first appendage 188) 360°. Thus, the first appendage 188 and the second appendage 198 have a minimum range of motion of 180° in one plane and 90° in a second plane. Additionally, the first end component 180 and the second end component 190 have a separate minimum range of motion of 180° in one plane and 90° in a second plane.

A plurality of primary spacer elements 140 can be provided. As illustrated, the primary spacer elements 140 can have two substantially parallel sides with an aperture formed therethrough. At least some configurations a continuous exterior surface of the primary spacer elements 140 are smooth, while in other configurations, the continuous exterior surface has teeth. In some configurations, the continuous exterior surface (formed between the two substantially parallel surfaces) can be substantially, square, rectangular, ovoid, triangular or circular. The aperture can be formed centrally or off-center. For purposes of illustration, the primary spacer elements 140 are illustrated as substantially circular with a cog shape in two dimensions and a central aperture. Two or more first end components 180, and second end components 190 (forming hands and feet) having two notches at an orientation less than 180° (illustrated as 90°) and an aperture between the two notches are provided which can be positioned at the end of a length of a plurality of primary spacer elements 140. Alternatively, the notches for the first end component 180 and the second end component 190 can be positioned along the same axis. Two or more primary mid-spacers 150 can be provided which have two notches which are aligned along an axis and are also connected via an aperture. Secondary spacer elements 160, 170 which are larger or smaller in at least one dimension (e.g., radius) than the primary spacer elements 140 can also be provided. The secondary spacer elements 160, 170 can form the wrist and the ankle of a robot articulatable toy.

FIG. 3 illustrates an articulated toy 120 with the interior apertures visible. A plurality of fanciful shaped elements 128 can be provided which fit within the countersunk hole 129 which forms a cavity of the second block 124. One or more elastic cables 112 (or cords) can pass through a plurality of elements and be secured through an aperture of a terminal element. The first end components 180, and second end components 190 can be separated from a second block 124 by a plurality of primary spacer elements 140. The plurality of primary spacer elements 140 can further be separated by one or more primary mid-spacers 150. The first end components 180, and second end components 190, plurality of primary spacer elements 140, primary mid-spacers 150 are interconnected via one or more elastic cables 112. The apertures of the first block 130 and the second block 124 can be axial and configured to pass along an axis, or can be configured to cross planes at an angle from an axis. Other non-linear configurations can be employed without departing from the scope of the disclosure. Additional blocks can also be provided without departing from the disclosure.

Figure 4A:
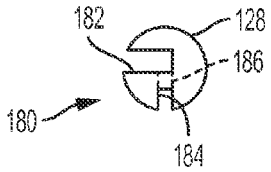
FIGS. 4A-F illustrate components of the articulated toy for hand, elbow/knee joints and foot from top (FIGS. 4A-C) and side views (FIGS. 4D-F) respectively.
Figure 4B:
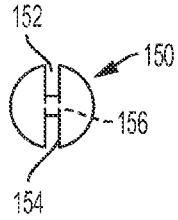
Figure 4C:
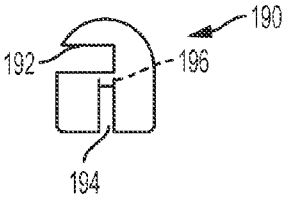
Figure 4D:
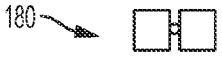
Figure 4E:
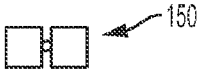
Figure 4F:
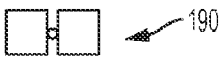

FIGS. 4A-F illustrate components of the articulated toy for elements having notches which are not aligned along a single axis, and aligned along a single axis notched primary mid-spacers 150 from top (FIGS. 4A-C) and side views (FIGS. 4D-F) respectively. Turning to FIG. 4A and the corresponding side view of FIG. 4D, a first end component 180 is illustrated which has two substantially planar surfaces and a substantially circular shape in at least one plane. A first notch 182 is provided which is perpendicular, or substantially perpendicular to a second notch 184. In other configurations, the first notch 182 and the second notch 184 can be along the same axis or in the same plane. An aperture 186 communicates between the two notches. An elastic cable (not shown) passed through the aperture 186 from the second notch 184 to the first notch 182. A knot placed at the end of the elastic cable prevents the cable from freely passing through the aperture 186. The knot could then sit within one of the notches. The primary mid-spacers 150 shown in FIG. 4B and FIG. 4E. The primary mid-spacers 150 has a first notch 152 and a second notch 154 which is in the same axis as the first notch 152. An primary mid-spacers aperture 156 passes from the first notch 152 to the second notch 154. An elastic cable (not shown) can pass through the primary mid-spacers 150 when it is positioned between other elements. The primary mid-spacers 150 can rotate about the elastic cable. The primary mid-spacers operate as a pop-up joint during use when positioned between other components or spacers. An additional configuration of a second end component 190 is illustrated in FIG. 4C and FIG. 4F. The second end component 190 is similar to first end component 180, in that the second end component 190 has a first notch 192 and a second notch 194 which is perpendicular to the first notch 192. In other configurations, the first notch 192 and the second notch 194 can be along the same axis or in the same plane. An aperture 196 also passes from the first notch 192 to the second notch 194, and an elastic cable (not shown) can also pass through the aperture 196 and be secured by a knot. However, the second end component 190, as illustrated, takes a secondary shape from the first end component 180, as illustrated. The first notch 192 of the second end component 190 can function as a hook allowing the second end component 190 to engage an associated device with another structure. In the secondary shape, the end component is partially circular at one end, and flat at a second end opposing the semicircular end.

Figures 5A, 5B, 5C, 5D, 5E, 5F:
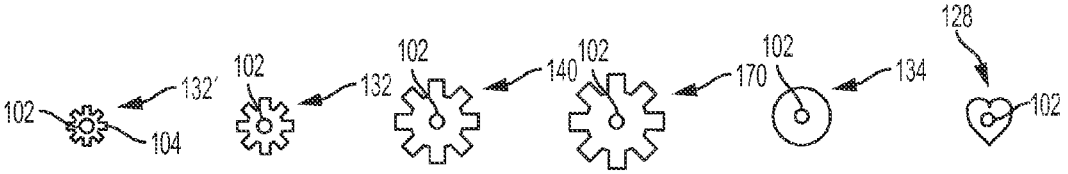
FIGS. 5A-L illustrate the body components from top (FIGS. 5A-F) and side views (FIGS. 5G-L) respectively.
Figures 5G, 5H, 5I, 5J, 5K, 5L:
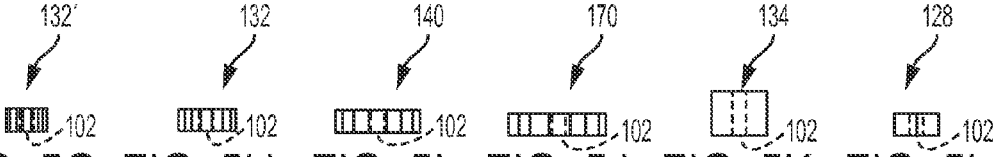

FIGS. 5A-L illustrate the body components and spacers from top (FIGS. 5A-F) and side views (FIGS. 5G-L) respectively. FIGS. 5A-5B (and corresponding side views FIGS. 5G-5H) illustrate second decorative elements 132, 132' (left and right eyes) The eyes can also be cog shaped with teeth. An aperture 102 is provided therethrough. FIGS. 5C-5D (and corresponding side views FIGS. 5I-5.1) illustrate a primary spacer element 140 and a secondary spacer element 170. The spacers can be cog shaped with teeth as illustrated. An aperture 102 is provided therethrough. FIG. 5E (and corresponding side view FIG. 5K), is a circular element with an aperture 102 therethrough. Lastly, FIG. 5F (and corresponding side view FIG. 5L) is one or more fanciful shaped elements 128 which is illustrated as heart shaped in a first dimension. The one or more fanciful shaped elements 128 also has an aperture 102 therethrough.

Figure 6A:
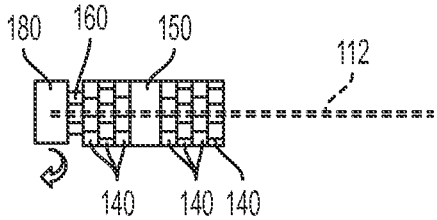
FIGS. 6A-F illustrate pop-up joint, twisting/lengthening/shortening of the arm.
Figure 6B:
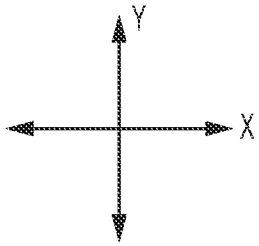
Figure 6B:
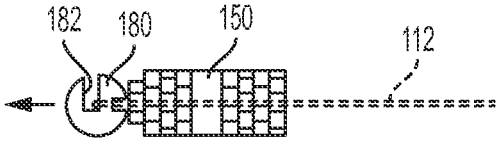
Figure 6C:
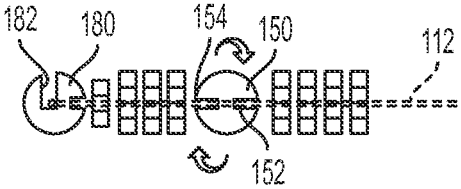
Figure 6D:
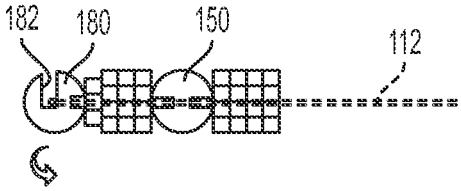
Figure 6E:
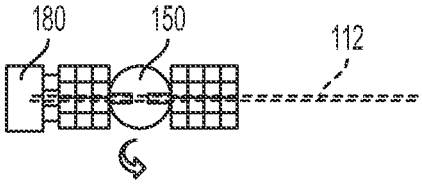
Figure 6F:
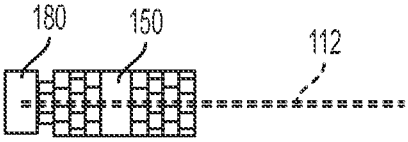

FIGS. 6A-F illustrate primary mid-spacers 150 which allows for one or more of twisting, lengthening, shortening of the arm by rotating the one or more first end components 180 and the primary mid-spacers 150. FIGS. 6A-F illustrate a first end component 180, a secondary spacer elements 160 (wrist component) a plurality of primary spacer elements 140, a primary mid-spacers 150, and an additional set of primary spacer elements 140, with an elastic cable 112 therethrough. In FIG. 6A, the first end component 180 and the primary mid-spacers 150 are positioned so that the component is sideways with its depth being adjacent to the depth of the primary spacer elements 140. In FIG. 6B the first end component 180 is turned 90° so that the first notch 182 is perpendicular to the axis formed by the length of the components. As shown in FIG. 6C the end component is turned 90° and the primary mid-spacers 150 is also turned 90°. In turning the joint 90°, the first notch 152 and the second notch 154 are aligned in the same axis as the length of the components. Additionally, the primary mid-spacers 150 and the first end component 180 can rotate 360° about an x axis formed by the length of the components. As shown in FIGS. 6D-E, the first end component 180 can be turned so that it returns to the position shown in FIG. 6A. Similarly, as shown in FIGS. 6E-F the primary mid-spacers 150 can be rotated so that it returns to the configuration of FIG. 6A.

Figure 7A:
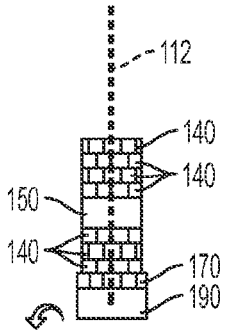
FIGS. 7A-F illustrate the pop-up joint, twisting/lengthening/shortening of the leg.
Figure 7B:
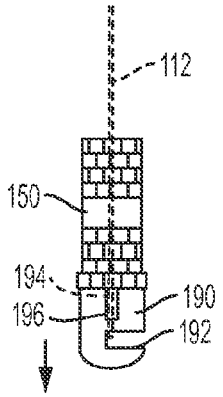
Figure 7C:
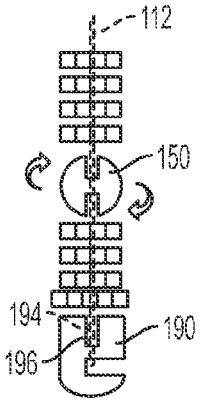
Figure 7D:
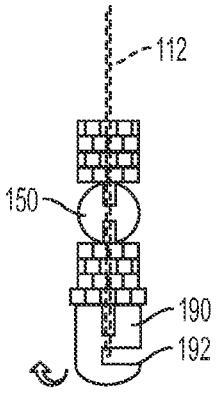
Figure 7E:
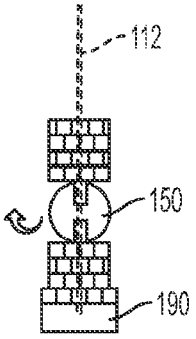
Figure 7F:
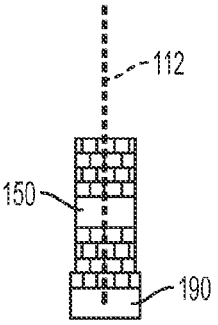

FIGS. 7A-F illustrate primary mid-spacers 150 which allows for one or more of twisting, lengthening, shortening of the leg by rotating the second end component 190 and the primary mid-spacers 150. FIGS. 7A-F illustrate a second end component 190, a secondary spacer element 170, a plurality of primary spacer elements 140, a primary mid-spacers 150, and an additional set of primary spacer elements 140, with an elastic cables 112 therethrough. In FIG. 7A, the second end component 190 and the primary mid-spacers 150 are positioned so that the component is sideways with its depth being adjacent to the depth of the primary spacer elements 140. In FIG. 7B the second end component 190 is turned 90° so that the first notch 192 is perpendicular to the y axis formed by the length of the components. As shown in FIG. 7C the second end component 190 is turned 90° and the primary mid-spacers 150 is also turned 90°. In turning the joint 90°, the first notch 152 and the second notch 154 are aligned in the same axis as the length of the components. Additionally, the primary mid-spacers 150 and the second end component 190 can rotate 360° about an x axis formed by the length of the components. As shown in FIGS. 7D-E, the second end component 190 can be turned so that it returns to the position shown in FIG. 7A. Similarly, as shown in FIGS. 7E-F the primary mid-spacers 150 can be rotated so that it returns to the configuration of FIG. 7A.

FIGS. 8A-E illustrate a second block 124 from front (FIG. 8A), rear (FIG. 8B), side (FIG. 8C), top (FIG. 8D) and bottom (FIG. 8E) view. The second block 124 has a pair of planar notches 125, 125' which are on opposing sides of the block in the same cross-sectional plane of the second block 124, and a pair of adjacent notches 127, 127' which are adjacent each other on a single side of the second block 124 which is different than the opposing sides that define the planar notches 125.

Figure 8A:
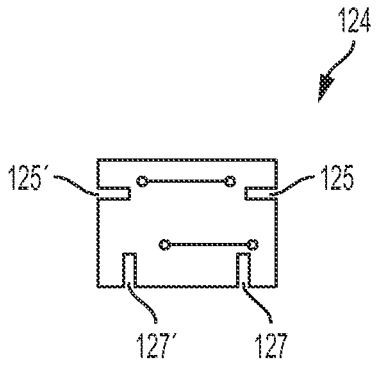
FIGS. 8A-E illustrate a torso from front, rear, side, top and bottom views.
Figure 8B:
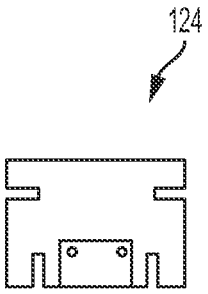
Figure 8C:
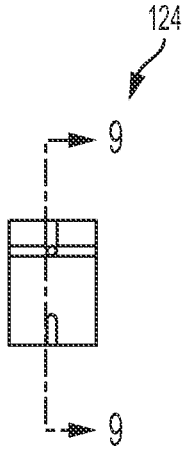
Figure 8D:
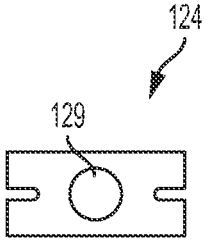
Figure 8E:
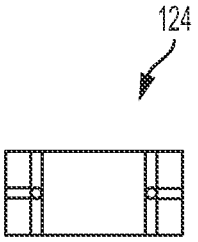
Figure 9:
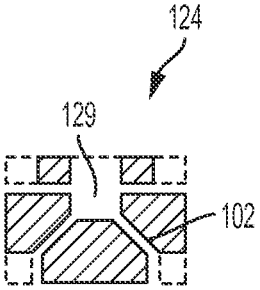
FIG. 9 is a cross-sectional view through torso along the lines 9-9 in FIG. 8C with secret cavity.

FIG. 9 is a cross-sectional view through the second block 124 along the lines 9-9 in FIG. 8C with countersunk hole 129. Apertures 102 are provided which connect the planar notches 125, 125', and the adjacent notches 127, 127' to a countersunk hole 129 that forms a secret cavity.

FIGS. 10A-E illustrate a first block 130 from a front (FIG. 10A), rear (FIG. 10B), side (FIG. 10C), top (FIG. 10D) and bottom (FIG. 10E) view. The first block 130 has one or more second decorative elements 132, 132', and circular elements 134, 134' attached to an exterior surface thereof. Additional etchings can be provided. An aperture 102 passes through the first block 130. The aperture 102 can have a countersink at one or both ends, which results in a widened opening.

Figure 10A:
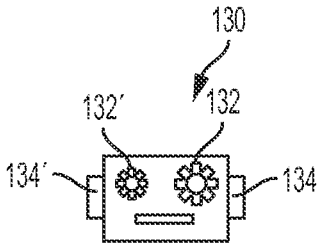
FIGS. 10A-E illustrate a head from front, rear, side, top and bottom views.
Figure 10B:
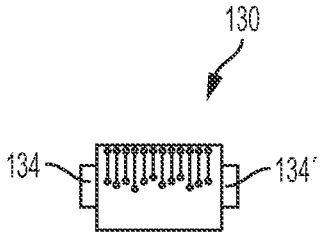
Figure 10C:
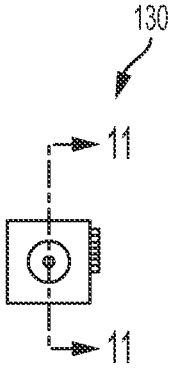
Figure 10D:
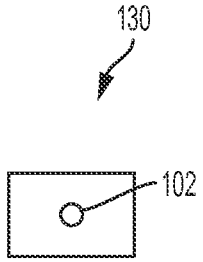
Figure 10E:
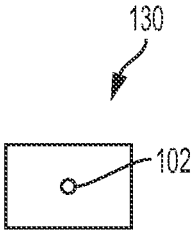
Figure 11:
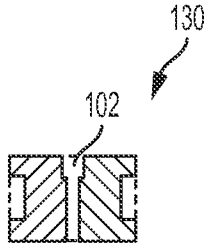
FIG. 11 is a cross-sectional through head along the lines 11-11 in FIG. 10C.

FIG. 11 is a cross-sectional through head along the lines 11-11 in FIG. 10C showing the aperture 102 having a widened opening at one end. An aperture can be provided which allows a spring to be positioned therein.

Figure 12:
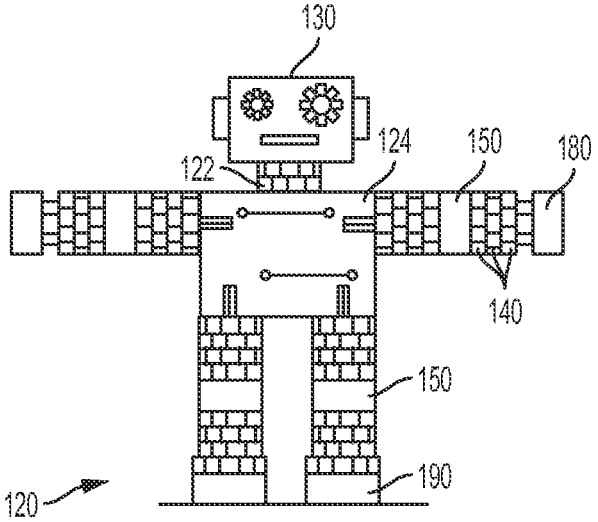
FIGS. 12, 13, 14 illustrate the articulated toy from a front, side, and rear view.
Figure 13:
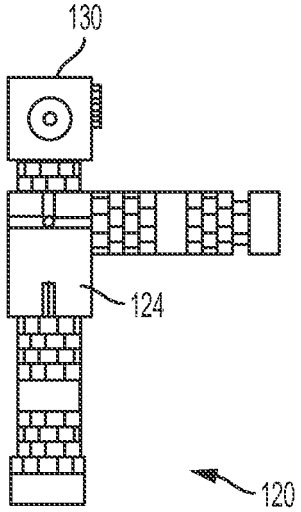
Figure 14:
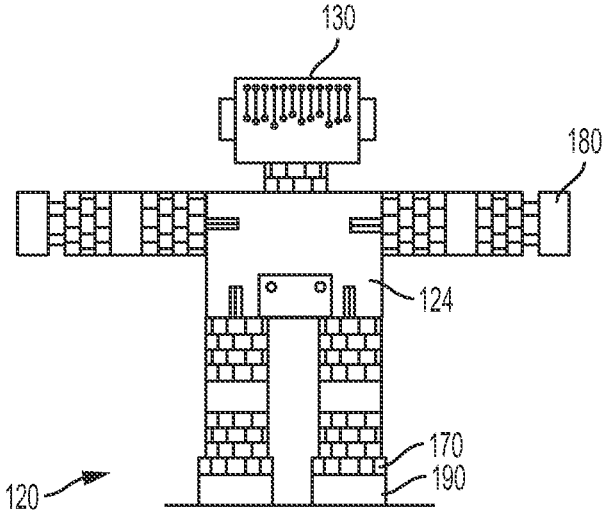

FIGS. 12, 13, 14 illustrate the articulated toy 120 from a front (FIG. 12), side (FIG. 13), and rear view (FIG. 14). The center axis of the arms and the legs aligns with the notches in the body.

Figure 15:
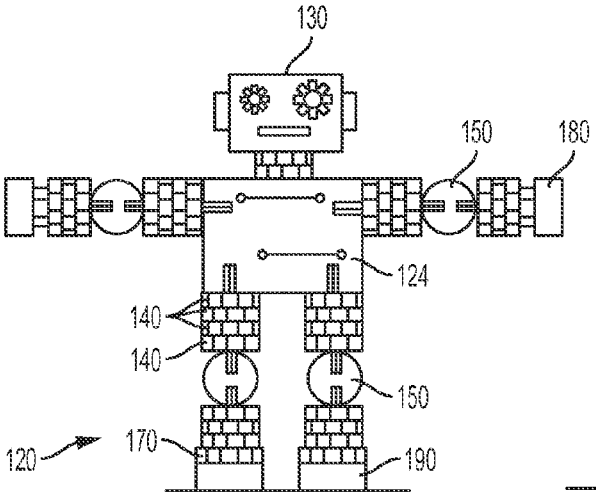
FIGS. 15, 16, 17 illustrate the articulated toy from a front, side, and rear view with joints popped-up.
Figure 16:
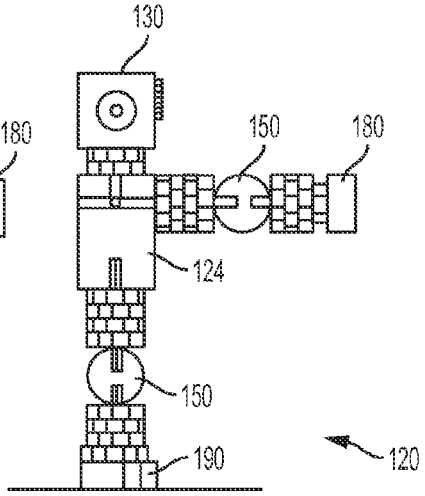
Figure 17:
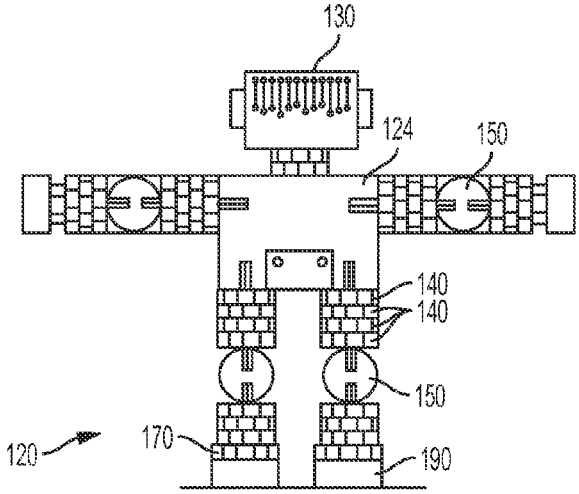

FIGS. 15, 16, 17 illustrate the articulated toy 120 from a front (FIG. 15), side (FIG. 16), and rear view (FIG. 17) with joints popped-up (as shown in FIGS. 6C-D and FIGS. 7C-D).

Figure 18:
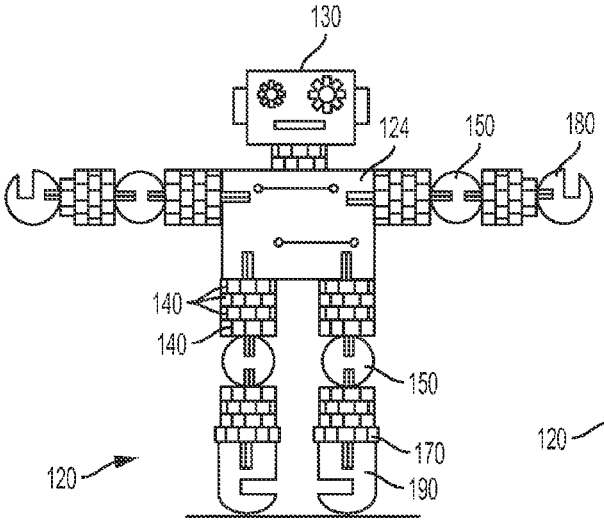
FIGS. 18, 19, 20 illustrate the articulated toy from a front, side, and rear view with hands and feet extended.
Figure 19:
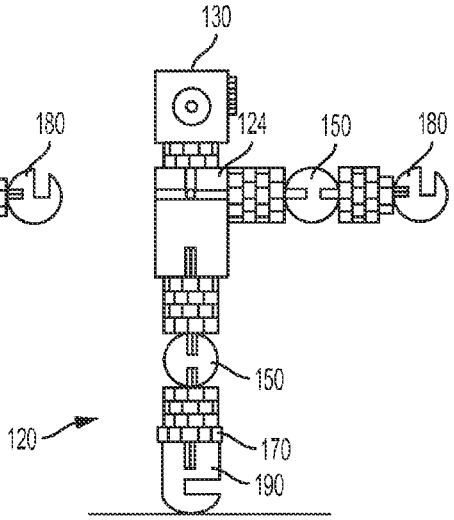
Figure 20:
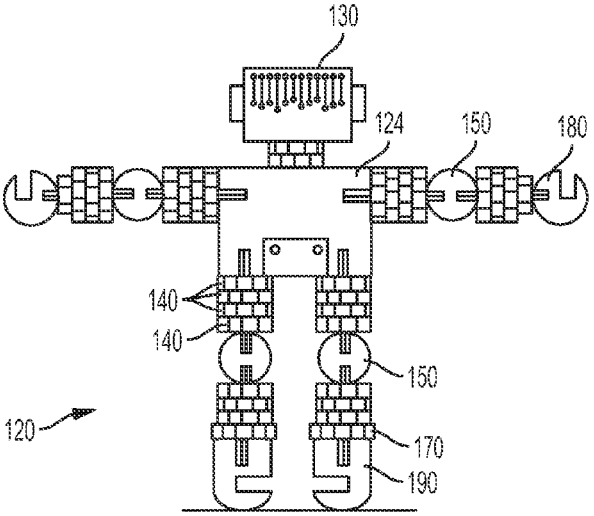
Figure 21:
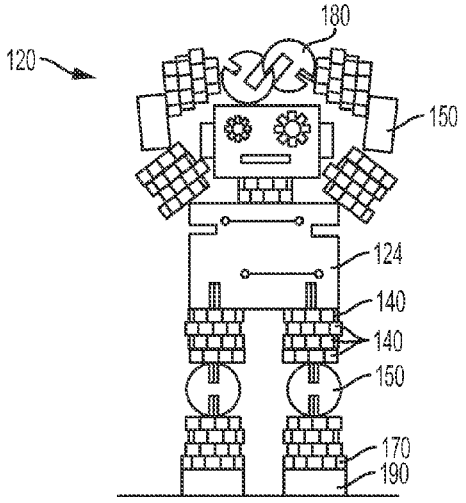
FIGS. 21-29 illustrate one or more articulated toys in various positions, standing, balancing on one leg, sitting, grasping hands, holding foot, crouching, connecting to other toys.
Figure 22:
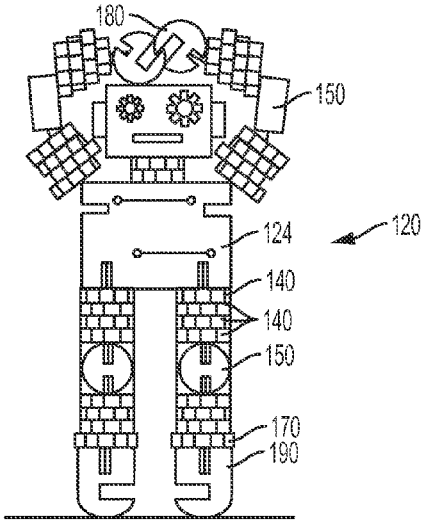
Figure 23:
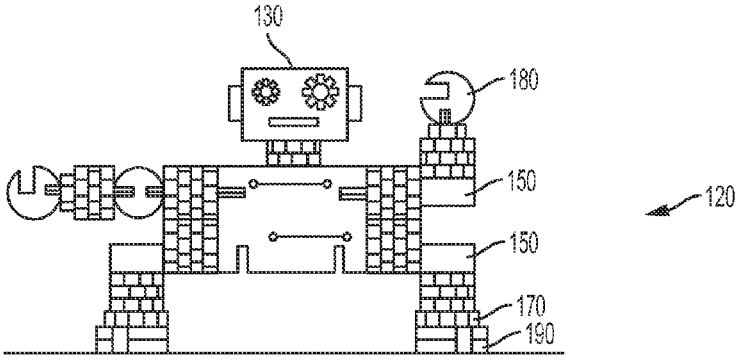
Figure 24:
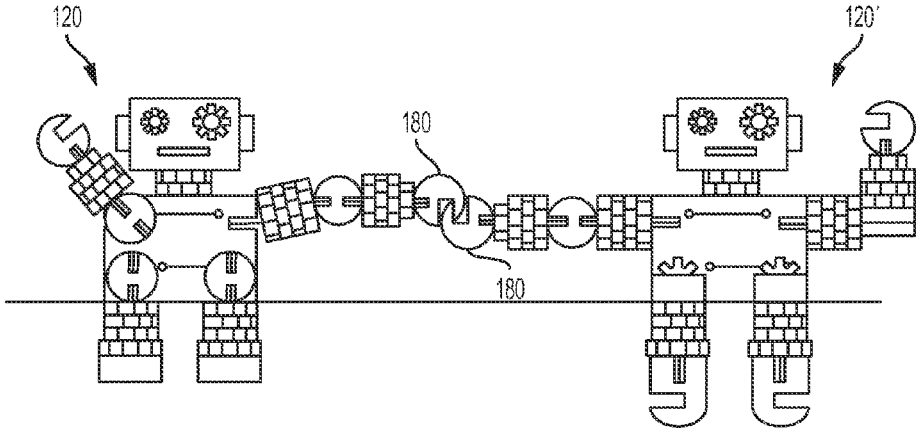
Figure 25:
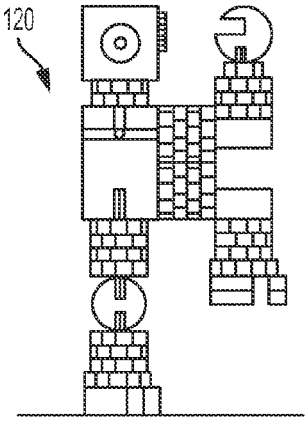
Figure 26:
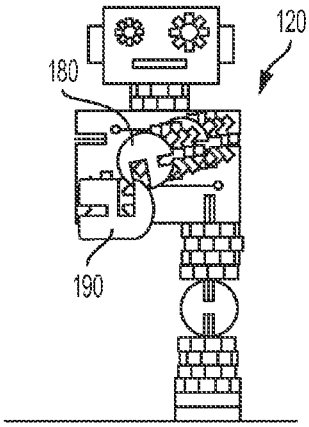
Figure 27:
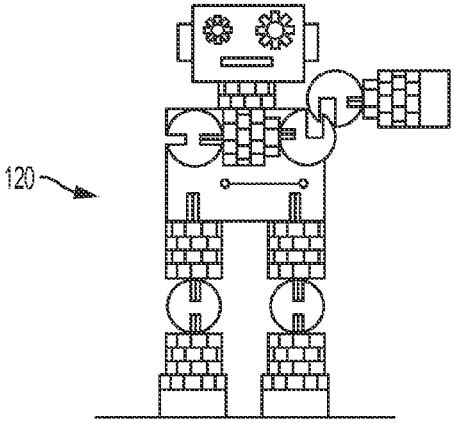
Figure 28:
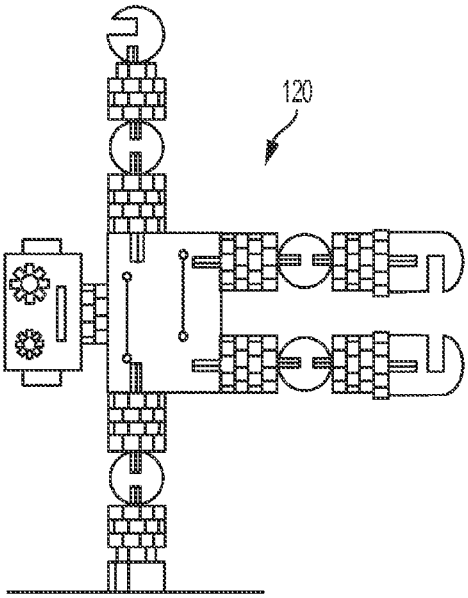
Figure 29:
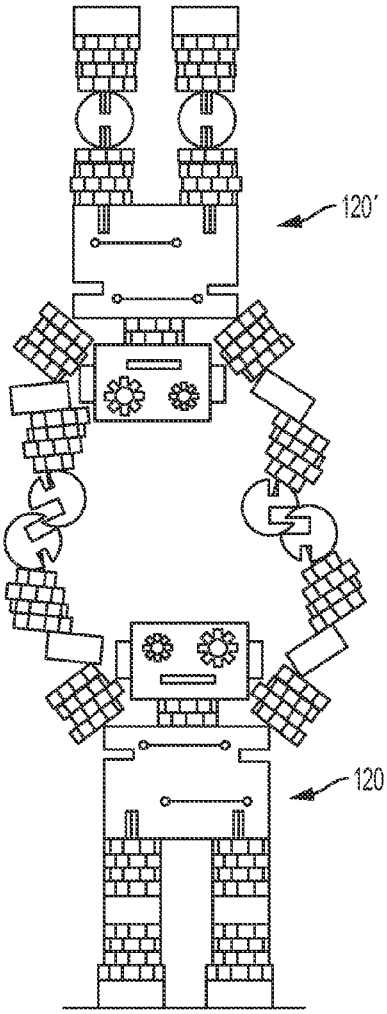

FIGS. 18, 19, 20 illustrate the articulated toy from a front (FIG. 18), side (FIG. 19), and rear view (FIG. 20) with both joints and hands and feet extended (as shown in FIGS. 6C-D and FIGS. 7C-D).

FIGS. 21-29 illustrate one or more articulated toys in various positions, standing, balancing on one leg, sitting, grasping hands, holding foot, crouching, connecting to other toys. The first notch of the second component is shown engaging another first notch of a second component in FIGS. 21, 22, 24, 26, or a first notch of a second component for another device FIG. 29.

Figure 30:
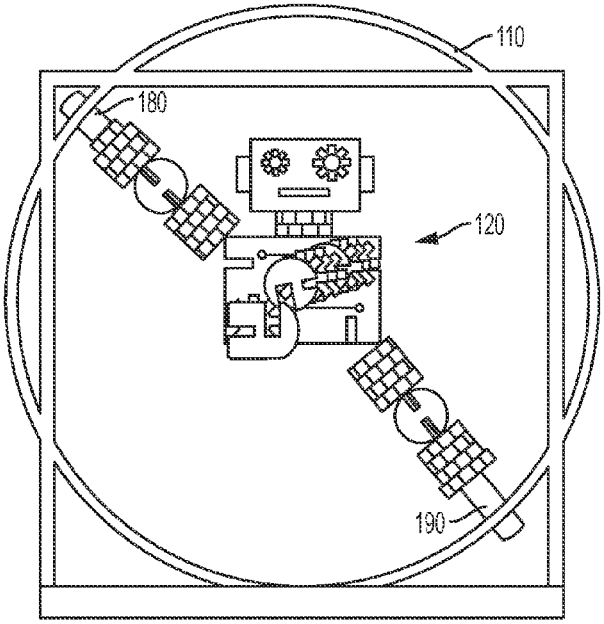
FIGS. 30-34 illustrate an articulated toy positioned within a frame and having a base.
Figure 31:
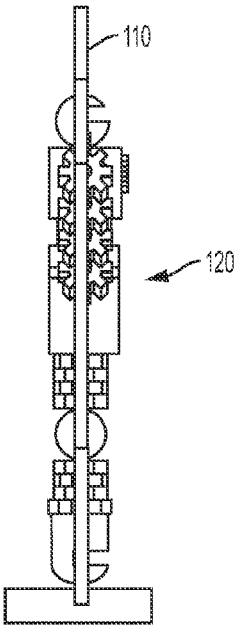
Figure 32:
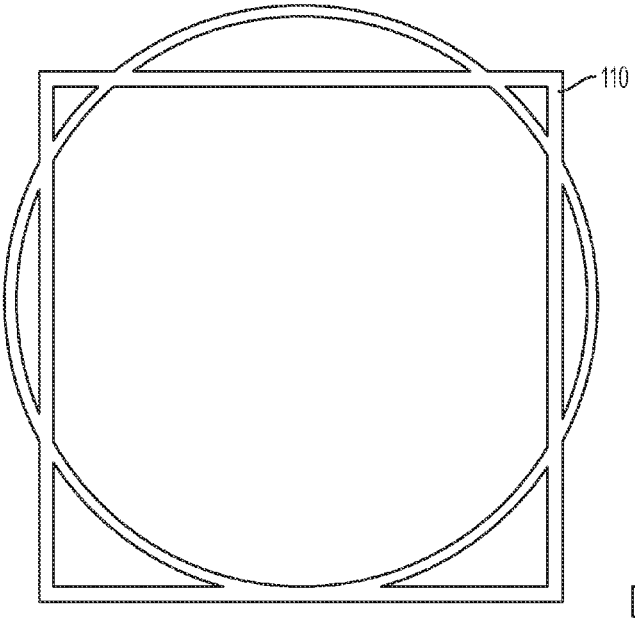
Figure 33:
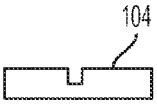
Figure 34:
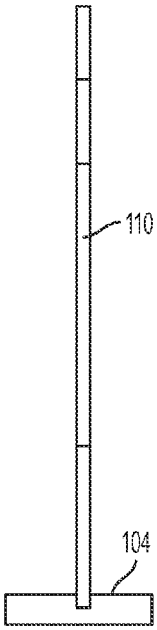

FIGS. 30-34 illustrate an articulated toy 120 positioned within a frame 110 and having a base. The first notch of the second component can be used to engage the frame as shown in FIG. 30. Moreover, the frame 110 can have a base 104 that is separatable from the frame 110.

Figure 35:
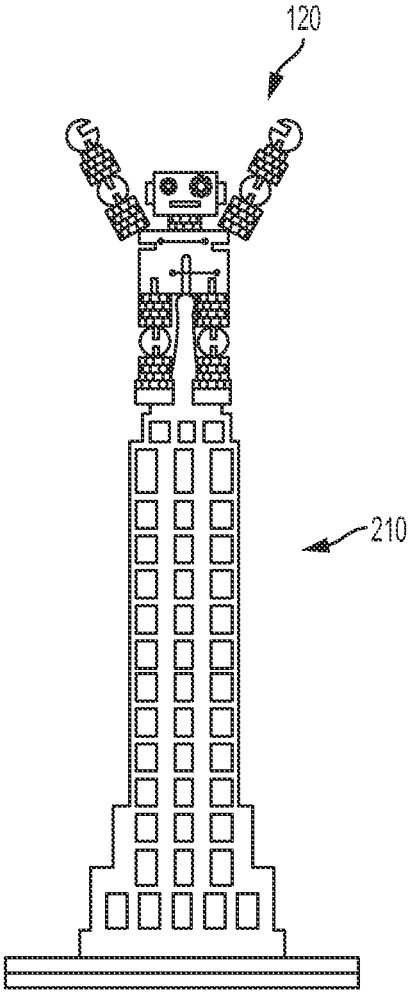
FIGS. 35-37 illustrate an articulated toy interacting with 2D building accessory.
Figure 36:
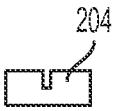
Figure 37:
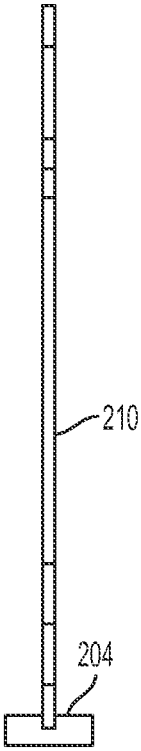
Figure 38:
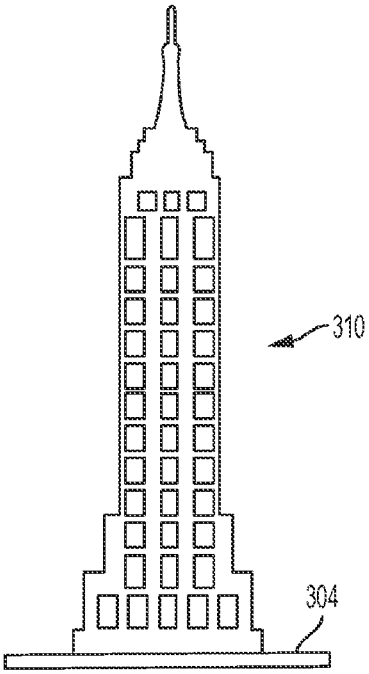
FIGS. 38-45 illustrate exemplar 2D building accessories.
Figure 39:
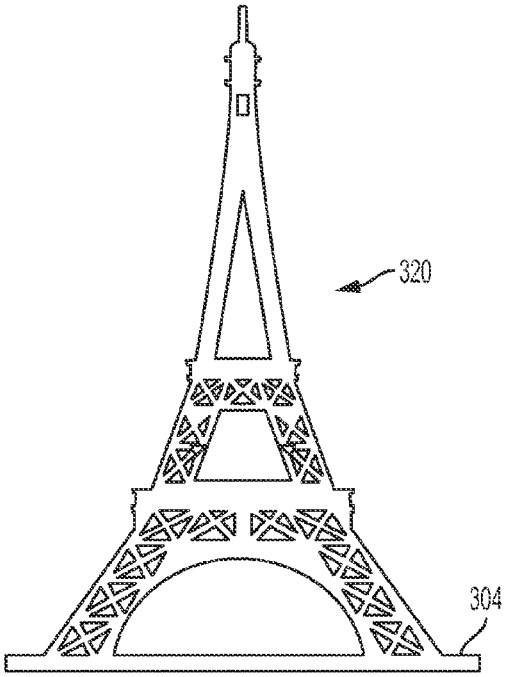
Figure 40:
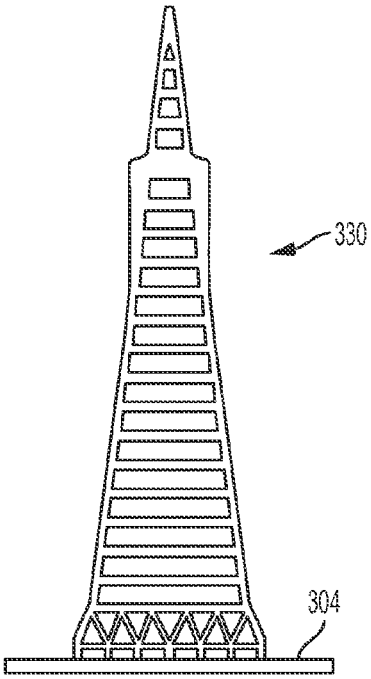
Figure 41:
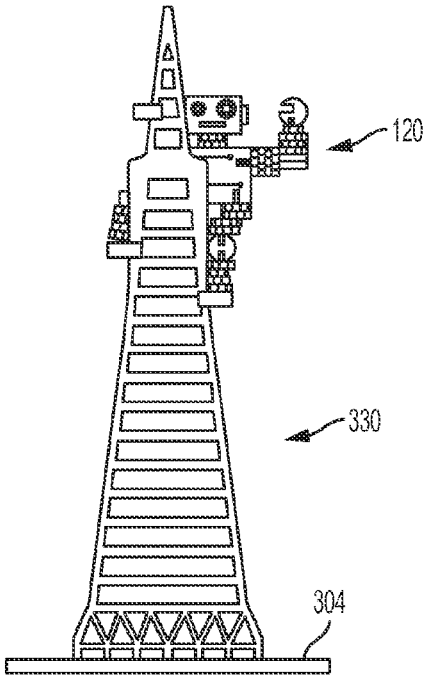
Figure 42:
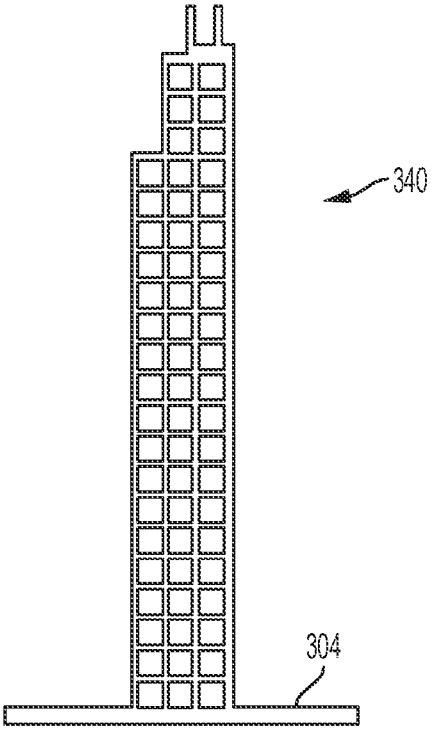
Figure 43:
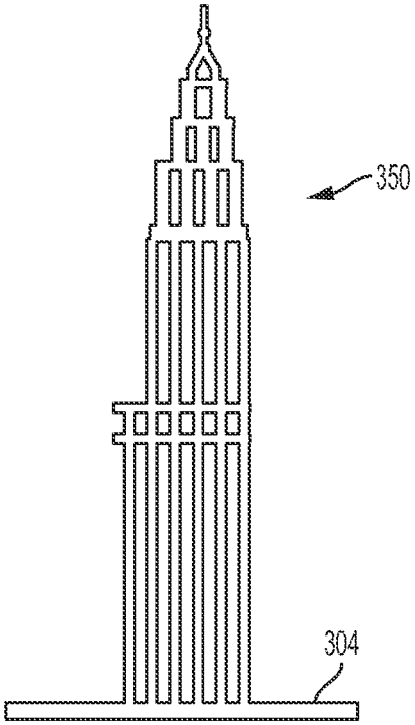
Figure 44:
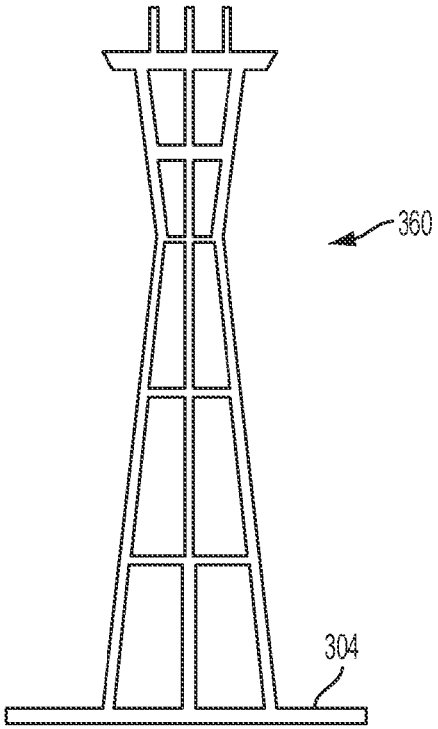
Figure 45:
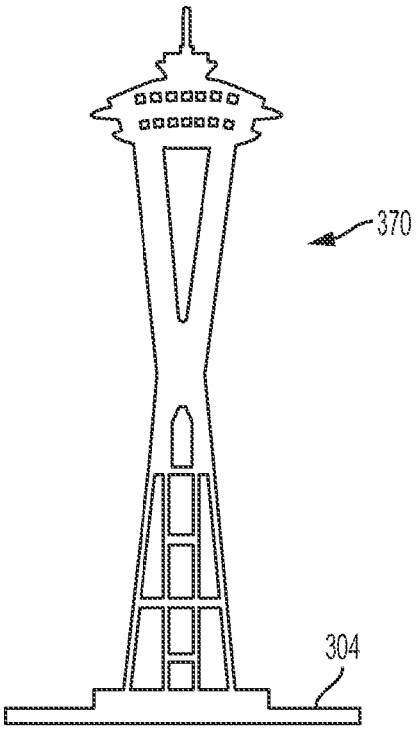

FIGS. 35-37 illustrate an articulated toy 120 interacting with 2D building accessory 210 where the building accessory 210 can also be separatable from a base 220.

FIGS. 38-45 illustrate exemplar 2D building accessories 310, 320, 330, 340, 350, 360, 370 with which an articulated toy 120 can be removably engaged, where the 2D building accessories can be, for example, the Empire State Building, the Eiffel Tower, the Transamerica Building, Willis Tower (formerly Sears Tower), Sutro Tower and the Space Needle. Other shapes can be used without departing from the scope of the disclosure, including, rockets, bridges, mountains, Ferris wheels, etc.

It should be noted that the buildings may be a variety of structures, vehicles, airborne devices. The design may include three-dimensional forms.

The first block 130, FIG. 10A through FIG. 11, can have a countersunk hole 116 connected to a through hole aperture 118. The one or more circular elements 134 can be sunken and glued into a cavity. Alternatively, the circular elements 134 can be affixed using any suitable method including the use of screws, dowels, etc. The one or more second decorative elements 132 can be glued to an exterior surface of the first block 130 adding to the tactile experience. Other features, such as the mouth and hair, can be laser etched to the exterior surface of the first block 130. Other appropriate engraving methods may be used without departing from the scope of the disclosure.

The second block 124, as shown in FIG. 3 and FIG. 9, can be formed to provide a cavity 129 that is not visible from the exterior of the second block 124 when the toy is assembled. As shown one or more fanciful shaped elements 128 are one or more hearts which can be provided which fit within the countersunk hole 129 forming a cavity. The cavity is accessed through four apertures or through holes. Additionally, the one or more fanciful shaped elements can light-up or glow by using electronic components, light capturing material, or an external paint treatment.

All shapes are interconnected by one or more elastic cables (or cords) held in tension by end knots that are larger than the diameter of the apertures the cables are passed through. It should be noted that the elastic cables or cords may be secured by other appropriate mechanical fasteners or devices.

The arms are composed of a first end component 180 (forming a hand), a secondary spacer elements 160 (forming a wrist), limb elements in the shape of primary spacer elements 140 (in the shape of a flat cog or gear) and a primary mid-spacers 150 (forming a pop-up elbow or knee joint). All elements have a through hole. The arms are held in tension by an elastic cable terminated by a knot 114 on both the right and left hands.

The pop-up elbow joint is preferably a disk with two slots and a through hole. The joint can be folded onto itself and disappear. It can also pop-up in a twisting rotation when a pulling force is applied to the first end component 180. This function allows for the configuration of the limb to shorten or lengthen. FIG. 6A through 6F illustrate how the joint, formed by the primary mid-spacers 150, twists and pops-up.

The first end component 180 has two slots. One slot allows for the hand to rotate around the axis of the elastic cable. The other allows for gripping. The hand in conjunction with the pop-up elbow joint permits all of the elements of the limbs to move in all directions, lateral and circular as well as shortening, lengthening and gripping.

The legs are composed of a second end component 190 (forming a foot), an secondary spacer element 170 (forming an ankle), primary spacer elements 140 which can form the limbs of the articulated toy 120 and a primary mid-spacers 150. All elements have a through hole. An elastic cable passes through each leg, then through the torso's secret cavity, where the two hearts are inserted. The cables are then fed through the neck and are tied with a knot at a countersunk hole 116.

When the robot is in its natural state, the hearts are not visible. Only by bending the neck do the hearts appear, adding an element of discovery.

The pop-up knee joint is similar to the elbow joint. It is preferably a disk with two slots and a through hole. The joint can be folded onto itself and disappear. It can also pop-up in a twisting rotation when a pulling force is applied to the second end component 190. This function allows for the configuration of the limb to become shorter or longer. FIGS. 7A-7F illustrate how the joint twists and pops up.

The second end component 190 has two slots. One slot allows for the foot to rotate around the axis of the elastic cable. The other allows for gripping. The hand, in conjunction with the pop-up elbow joint, permits all of the elements of the limbs to move in all directions, lateral and circular as well as shortening, lengthening and gripping.

The frame 110 can be laser cut. It sits on a removable base 104. The grip of the robot's hand and feet is slightly larger than the thickness of the frame so it can connect to it by friction. Depending on the material used, the connection may be mechanical, electrical. magnetic.

The first block 130 (e.g., a head), second block 124 (e.g., a torso) and removable base 104 are cut using traditional woodworking tools. All the other elements are laser cut. It should be noted that other manufacturing processes may be used. Depending on the material, the elements may be dye-cut, extruded, 3D printed, or CNC routed.

The building accessories shown in FIGS. 35-45 can be 2D laser cut shapes with removable bases 304. A grip of the robot's hand and feet can be slightly larger than the thickness of the buildings so it can connect to them by friction. Depending on the material used, the connection may be mechanical, electrical, magnetic. It should be noted that the buildings may be a variety of structures, vehicles, airborne devices. The design may include three-dimensional forms.

Figure 46:
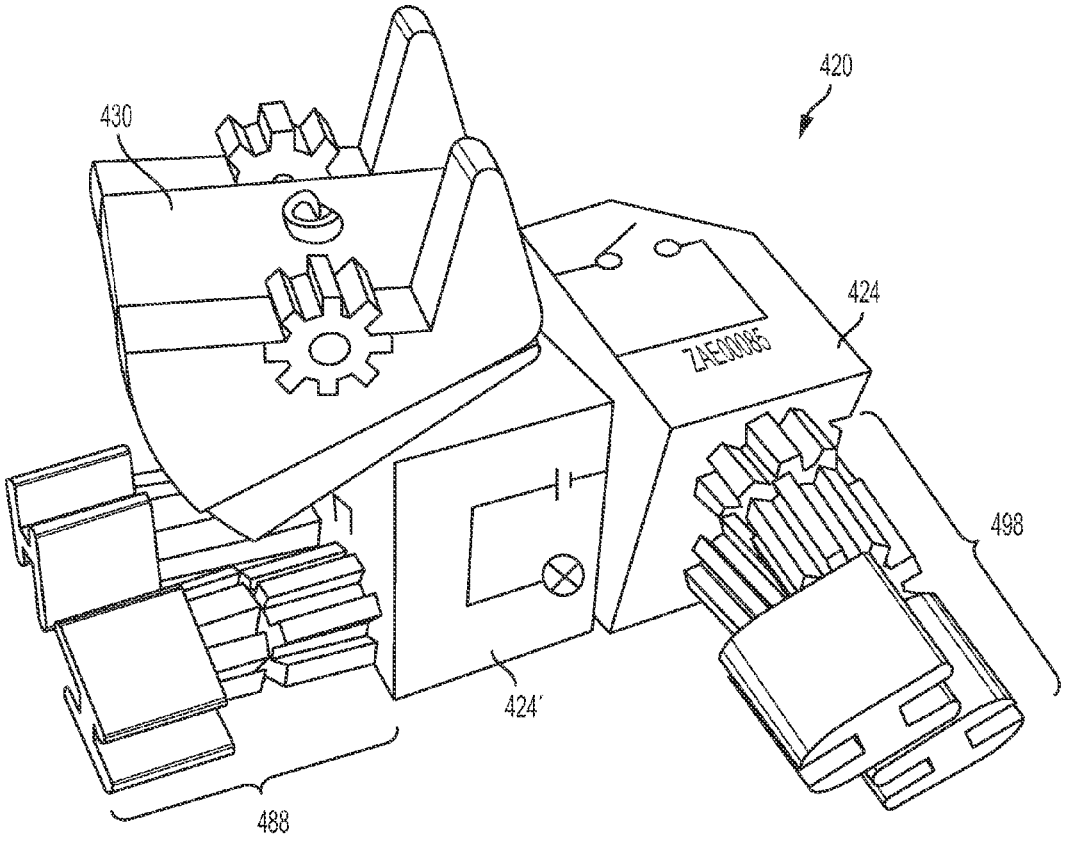
FIG. 46 is an alternative configuration of an articulatable toy.

FIG. 46 illustrates an alternative articulated toy 420 having a first block 430 and a second block 424. A third block 424' may also be provided which is adjacent to the second block 424. Two or more appendages 488, 498 can be provided which extend from the second block 424 or the third block 424'. Additionally, the block and appendages are configurable to include exterior channels, notches, apertures, and countersunk openings as described above with respect to FIGS. 2-11 above.

Figure 47A:
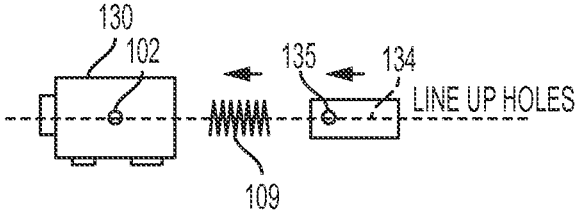
FIGS. 47A-C illustrate a process of putting components from a kit together into an exemplar articulable toy from a plurality of components.

FIG. 47A illustrates a process of compiling the first block 130. The first block 130 has an aperture 102 and defines an open space within the interior of the first block 130 that is sized to receive a spring 109 and a circular element 134 which can be a length of a dowel, for example, which is pushed into an opening in communication with the interior through an opening that is sized to snugly receive the circular element 134. Once positioned, the spring 109 is held in a compressed position within the interior of the first block 130.

Figure 47B:
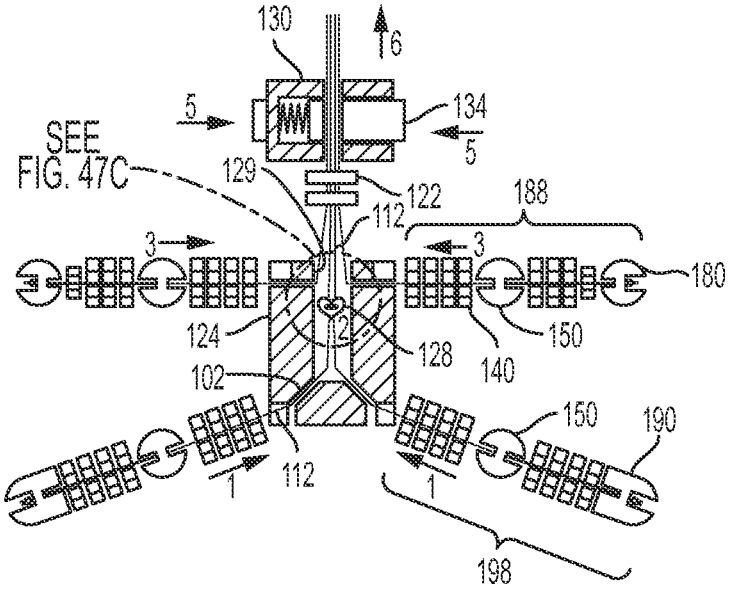
Figure 47C:
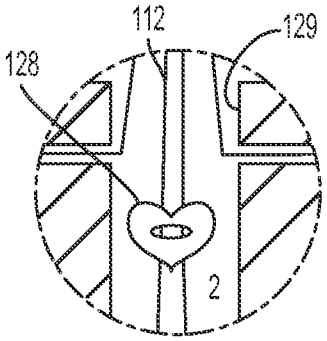

As shown in FIGS. 47B-C, to form a first appendage 188, or a second appendage 198, a knot 114 is tied at an end of an elastic cable 112 having a distal end and a proximal end. The unknotted end of the elastic cable 112 is then passed through a plurality of elements selected from a first end component 180, a second end component 190, a primary spacer element 140, a secondary spacer element 160, 170 a primary mid-spacers 150. As shown in FIG. 6, an exemplar configuration can be, for example, a first end component 180, a secondary spacer element 160, four primary spacer elements 140, a primary mid-spacers 150, and four primary spacer elements 140. Another exemplar configuration as shown in FIG. 7, can be, for example, a second end component 190, a secondary spacer element 170, four primary spacer elements 140, a primary mid-spacers 150, and four primary spacer elements 140. The proximal end of the elastic cable is then passed through an aperture in the secondary block 124 (shown as arrows 1 for the second appendages 198 and 3 for the primary appendages 188), the elastic cables pass through the interior of the second block 124 (shown by 2) and then extends out the countersunk hole 129 up through the at least one spacer element 122. The circular element 134 on either side of the first block 130 are squeezed to compress the spring 109 (as shown by arrows 5), and the elastic cable is then passed through the first block (shown by arrow 6). The ends of the elastic cables can then be tied to prevent the elastic cable from passing back through the apertures to secure the configured articulatable toy in the desired configuration or untied at a later time to allow the components to be reordered and reconfigured, as desired.

As shown in FIG. 47C one or more of the elastic cables can then be passed through an aperture of one or more fanciful shaped elements 128. As illustrated, the elastic cables associated with two secondary appendages is passed through one of one or more fanciful shaped element 128. However, as will be appreciated by those skilled in the art, the fanciful element can be associated with one or more appendages without departing from the scope of the disclosure. The one or more elastic cables can then be passed through an aperture in the primary block whereupon a secondary knot can be provided on the proximal end of the elastic cables.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed:

1. A kit for an articulatable toy comprising: a primary block having a primary block aperture passing therethrough along a primary block axis;

a secondary block, having a secondary block aperture passing at least partially therethrough along a secondary block axis, a primary exterior channel formed through a portion of the secondary block, and at secondary exterior channel formed through a portion of the secondary block in perpendicular communication with the primary exterior channel;

four or more spacers having a spacer aperture passing therethrough along a spacer axis;

one or more mid-spacer elements having a first mid-spacer element notch formed along an axis and a second mid-spacer element notch formed along the same axis as the first notch and having a mid-spacer element aperture therethrough from the first mid-spacer element notch to the second mid-spacer element notch; and a cable having a proximal end and a distal end.

2. The kit of claim 1 further comprising an end component having a first end component notch and a second end component notch formed at least one of perpendicularly to the first end component notch and planar to the first end of the component notch with a first element component aperture therethrough from the first end component notch to the second end component notch.

3. The kit of claim 2 wherein the end component has a rounded end and a flat end.

4. The kit of claim 1 further comprising one or more ornamental feature elements configurable to engage a surface of the primary block or the secondary block.

5. The kit of claim 4 wherein the ornamental feature elements have a shape selected from semi-circular, round, square, oval, ovoid, triangular, rectangular, and gear shaped.

6. The kit of claim 1 further comprising one or more secondary spacers, wherein the secondary spacers have a secondary spacer diameter that is larger or smaller than a spacer diameter of the four or more spacers.

7. The kit of claim 1 wherein the primary block has a shape selected from semi-circular, round, square, oval, ovoid, triangular, and rectangular.

8. The kit of claim 1 wherein the secondary block has a shape selected from semi-circular, round, square, oval, ovoid, triangular, and rectangular.

9. The kit of claim 1 wherein the secondary block has two or more additional primary external channels formed through a portion of the block which are not in communication with another primary external channel, and at two or more secondary external channels formed through a portion of the block not in communication with another secondary external channel and each in perpendicular communication with one of the additional primary external channels.

10. The kit of claim 1 further comprising at least one of a frame and a base.

11. The kit of claim 1 further comprising one or more planar shapes in the form of a building.

12. The kit of claim 1, the primary block having an open space within the interior of the primary block sized to receive and hold a spring in a compressed position within said open space.

13. An articulatable toy comprising;

a primary block having a primary block aperture passing therethrough along a primary block axis;

a secondary-block having a secondary block aperture passing at least partially therethrough along a secondary block axis, a primary external channel formed through a portion of the secondary block, and a secondary external channel formed through a portion of the secondary block in perpendicular communication with the primary external channel;

four or more spacers having a spacer aperture passing therethrough along a spacer axis;

one or more mid-spacer elements having a first mid-spacer element notch formed along an axis and a second mid-spacer element notch formed along the same axis as the first notch and having a mid-spacer element aperture therethrough from the first mid-spacer element notch to the second mid-spacer element notch; and a cable passing through one or more of the primary block aperture, the secondary block aperture, the four or more spacer apertures and at least one mid-spacer aperture.

14. The articulatable toy of claim 13 further comprising an end component having a first end component notch and a second end component notch formed perpendicularly to the first end component notch and a first end component notch aperture therethrough from the first end component notch to the second end component notch.

15. The articulatable toy of claim 14 wherein the end component has a rounded end and a flat end.

16. The articulatable toy of claim 13 further comprising one or more ornamental feature elements configurable to engage a surface of the primary block or the secondary block.

17. The articulatable toy of claim 16 wherein the ornamental feature elements have a shape selected from semi-circular, round, square, oval, ovoid, triangular, rectangular, and gear shaped.

18. The articulatable toy of claim 13 further comprising one or more secondary spacers, wherein the secondary spacers have a secondary spacer diameter that is larger or smaller than a spacer diameter of the four or more spacers.

19. The articulatable toy of claim 13 wherein the primary block has a shape selected from semi-circular, round, square, oval, ovoid, triangular, and rectangular.

20. The articulatable toy of claim 13 wherein the secondary block has a shape selected from semi-circular, round, square, oval, ovoid, triangular, and rectangular.

21. The articulatable toy of claim 13 wherein the secondary block has two or more additional primary external channels formed through a portion of the block which are not in communication with another primary external channel, and at two or more secondary external channels formed through a portion of the block not in communication with another secondary external channel and each in perpendicular communication with one of the additional primary external channels.

22. A method of making an articulatable toy comprising:

tying a knot at a first end of a cable;

passing the cable through at least one of a primary end component aperture of a primary end component and a secondary end component aperture of a secondary end component;

passing the cable through one or more of each of a primary spacer element aperture of a primary spacer element, a primary mid-spacer element aperture of a primary mid-spacer, and a secondary spacer element aperture of a secondary spacer element, wherein the primary mid-spacer element aperture passes from a first mid-spacer element notch of the primary mid-spacer to a second mid-spacer element notch of the primary mid-spacer, and wherein the first and second mid-spacer element notches are formed along a mid-spacer element axis;

passing the cable through a secondary block aperture of a secondary block; and tying a knot at a second end of the cable.

23. The method of claim 22 further comprising the step of passing the cable through an aperture of a shaped element, wherein the shaped element is heart-shaped or anatomically shaped.

24. The method of claim 22 further comprising the step of passing the cable through a primary block aperture of a primary block.

25. An articulatable toy comprising:

a primary block means having a primary block aperture passing therethrough along a primary block axis;

a secondary block means having a secondary block aperture passing at least partially therethrough along a secondary block axis, a primary external channel formed through a portion of the secondary block means, and a secondary external channel formed through a portion of the secondary block means in perpendicular communication with the primary external channel;

four or more spacer means having a spacer aperture passing therethrough along a spacer axis;

one or more mid-spacer element means having a first mid-spacer element notch and a second mid-spacer element notch formed along a mid-spacer element axis and having a mid-spacer element aperture therethrough from the first mid-spacer element notch to the second mid-spacer element notch; and a cable means passing through one or more of the primary block aperture, the secondary block aperture, the four or more spacer apertures and at least one mid-spacer aperture.

26. The articulatable toy of claim 25 further comprising an end component means having a first end component notch and a second end component notch formed at least one of perpendicularly or planar to the first end component notch and an end component aperture therethrough from the first end component notch to the second end component notch.

27. The articulatable toy of claim 25 further comprising one or more ornamental feature element means configurable to engage a surface of the primary block means or the secondary block means.

28. The articulatable toy of claim 25 wherein at least one of the primary block means and the secondary block means has a shape selected from semicircular, round, square, oval, ovoid, triangular, and rectangular.

29. The articulatable toy of claim 25 wherein the secondary block means has two or more additional primary external channels formed through a portion of the block which are not in communication with another primary external channel, and at two or more secondary external channels formed through a portion of the block not in communication with another secondary external channel and each in perpendicular communication with one of the additional primary external channels.

* * * * *